US006074259A

United States Patent [19]

Lastrajoli et al.

[11] Patent Number: 6,074,259

[45] Date of Patent: Jun. 13, 2000

[54] OFF-SHORE REFUSE COLLECTION DEVICE

[75] Inventors: Frédéric Lastrajoli; Emmanuel Petit, both of Borgo; Gérard Colombani, Bastia; Charles Lucchesi, Biguglia, all of France

[73] Assignee: SCP Embiu, Bastia, France

[21] Appl. No.: 09/077,525

[22] PCT Filed: Nov. 28, 1996

[86] PCT No.: PCT/FR96/01888

§ 371 Date: May 29, 1998

§ 102(e) Date: May 29, 1998

[87] PCT Pub. No.: WO97/19870

PCT Pub. Date: Jun. 5, 1997

[30] Foreign Application Priority Data

Nov. 30, 1995 [FR] France ..... 95 14461

[51] Int. Cl.[7] ..... B63B 22/00

[52] U.S. Cl. ..... 441/1

[58] Field of Search ..... 441/1, 6, 136; 114/263, 264, 266, 267, 343; 220/908

[56] References Cited

U.S. PATENT DOCUMENTS

| | | | |
|---|---|---|---|
| 1,700,153 | 1/1929 | Bradley | 114/263 |
| 3,602,925 | 9/1971 | Thompson | 4/171 |
| 5,388,717 | 2/1995 | LeVasseur | 220/908 |
| 5,476,187 | 12/1995 | Marisco | 220/908 |

FOREIGN PATENT DOCUMENTS

| | | |
|---|---|---|
| 2 638 436 | 5/1990 | France . |
| 92 00 872 U1 | 7/1992 | Germany . |
| 9200872 | 7/1992 | Germany . |
| 295 13 236 U1 | 11/1995 | Germany . |

*Primary Examiner*—Ed Swinehart
*Attorney, Agent, or Firm*—James C. Lydon

[57] ABSTRACT

A device for collecting refuse from moored ships, including a partially submerged float supporting a refuse collection box located above the water surface and having an open top for depositing refuse. The circular box includes an inner rotor with radial walls dividing the box into a plurality of compartments that each contain an open bag for receiving refuse deposited through the open top of the box. The bags filled with refuse are recovered from a craft by opening an access hatch and rotating the rotor so that each of the compartments may be accessed sequentially.

7 Claims, 2 Drawing Sheets

OFF-SHORE REFUSE COLLECTION DEVICE

TECHNICAL FIELD

The present invention relates to refuse collection offshore and particularly to a device for collecting refuse from moored ships, the type of which comprises a partially submerged float topped by a refuse collection container.

PRIOR ART

Getting rid of refuse is a real problem for ships staying in a harbour, in a bay or, generally speaking, for ships at anchor close to the shore. Sailors must use a tender craft to go ashore and get rid off their refuse into special containers.

Some refuse collection devices have already been thought of, such as the one set forth in the patent FR-A-2,638,436. Such a device is made up of a truncated buoy open on top for refuse to be thrown in, and comprises two handles for towing the buoy. Unfortunately, this kind of device is not stable enough and, due to the list caused by the wind in case of bad weather, may be partially filled with water. Furthermore, this device must be towed and hauled ashore for tipping refuse out when full.

SUMMARY OF THE INVENTION

This is why the object of the invention is to provide a refuse collection device for moored ships, such device being stable even when weather is bad and to enable refuse removal with no need to move the collection device.

The collection device according to the invention is therefore composed of a float for providing stability, topped by a collection container comprising an opening on top for refuse to be thrown- in, and at least one compartment provided with an open bag for receiving refuse and having a hatch door in its lateral wall for removing the bag filled with refuse from a craft.

According to a preferred embodiment, the collection container is round and comprises an inner rotor with radial walls dividing the container into a plurality of compartments, each containing a bag for receiving refuse thrown into the open top of the container. The bags filled with refuse are removed from a craft, after opening of the hatch door and rotation of the rotor for giving sequential access to each compartment.

BRIEF DESCRIPTION OF THE DRAWINGS

The objects, features and other characteristics of the invention will become more apparent from the following description with reference to the accompanying drawings in which.

DETAILED DESCRIPTION OF THE INVENTION

Figure 1:
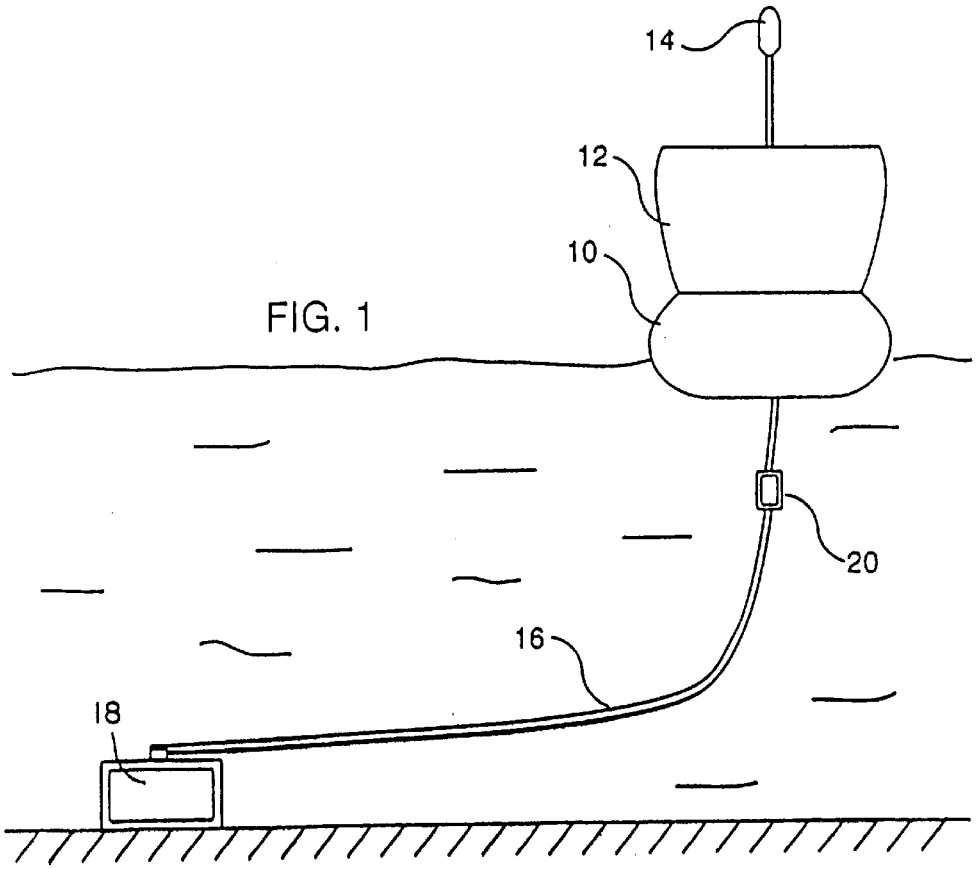
FIG. 1 shows the refuse collection device according to the invention anchored at sea by means of a mooring buoy.

The collection device according to the invention herein referred to as "sea garbage can" is a float shown on FIG. 1. This sea garbage can is made up of a partially submerged float 10 topped by a refuse collection container 12. The container 12 is open on top so that refuse from surrounding ships can be thrown into it. The device is provided with a central mast topped by a light 14 for signalling garbage can at night. The light is powered by a battery charged during the day by means of photovoltaic cells located at the lower part of the light (not shown on the figure).

The sea garbage can is anchored off-shore by means of a chain 16 hooked to a mooring buoy 18, the weight of which is determined from the assessment of the forces induced by the wind, sea streams and swell's action. For example, the weight of the mooring buoy may be 1000 kg. The chain 16, the length of which is about two times the water depth, is fixed to the garbage can by means of a central fastening device (not shown) located under the float 10 to facilitate ships' approaches. Furthermore, it is better to place a ballast 20 having a weight of about 100 kg on the chain with the aim, on the one hand, of keeping the chain vertically under the garbage can and, on the other hand, to ensure garbage can stability. Moreover, the ballast 20 helps prevent jolts that might occur on the fastening device of chain 20 to float 10 when the wind or the swell is strong.

Figure 2:
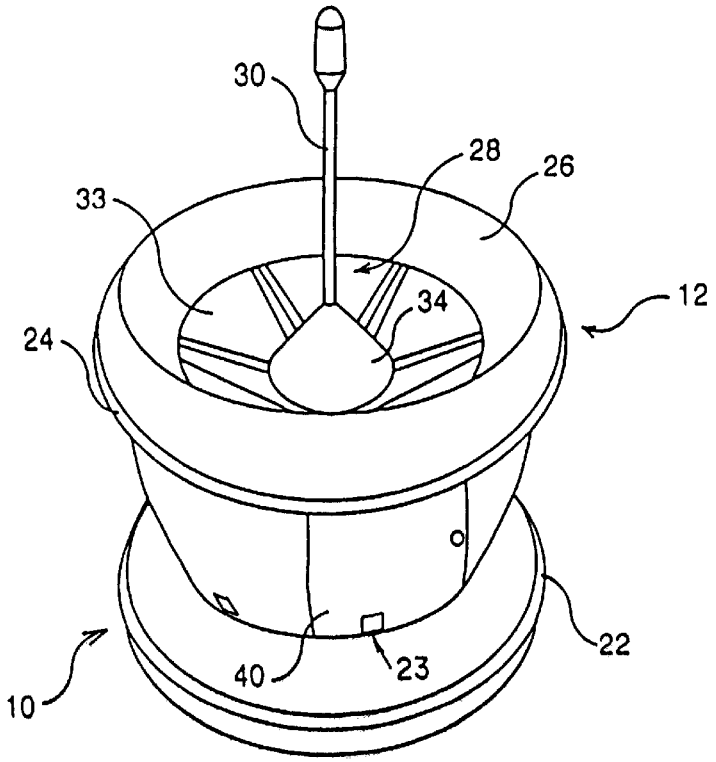
FIG. 2 shows a perspective view of the collection device according to the invention.

The sea garbage can, that is the object of the invention, is as shown on FIG. 2 on which the float 10 and the collection container 12 can be seen in perspective. The float 10, whose diameter may range from 2 m to 2.5 m is provided on its part having the highest diameter with a rubber fender 24 for damping possible shocks with largest ships.

The inner edge 26 of the collection container 12 is conical to facilitate the removal of refuse bags thrown into the container. It is to be noted that the angle of the inner edge 26 with a vertical line must not be high so as to prevent seagulls from perching there, what would have a repelling effect to the users of the sea garbage can.

Figure 3:
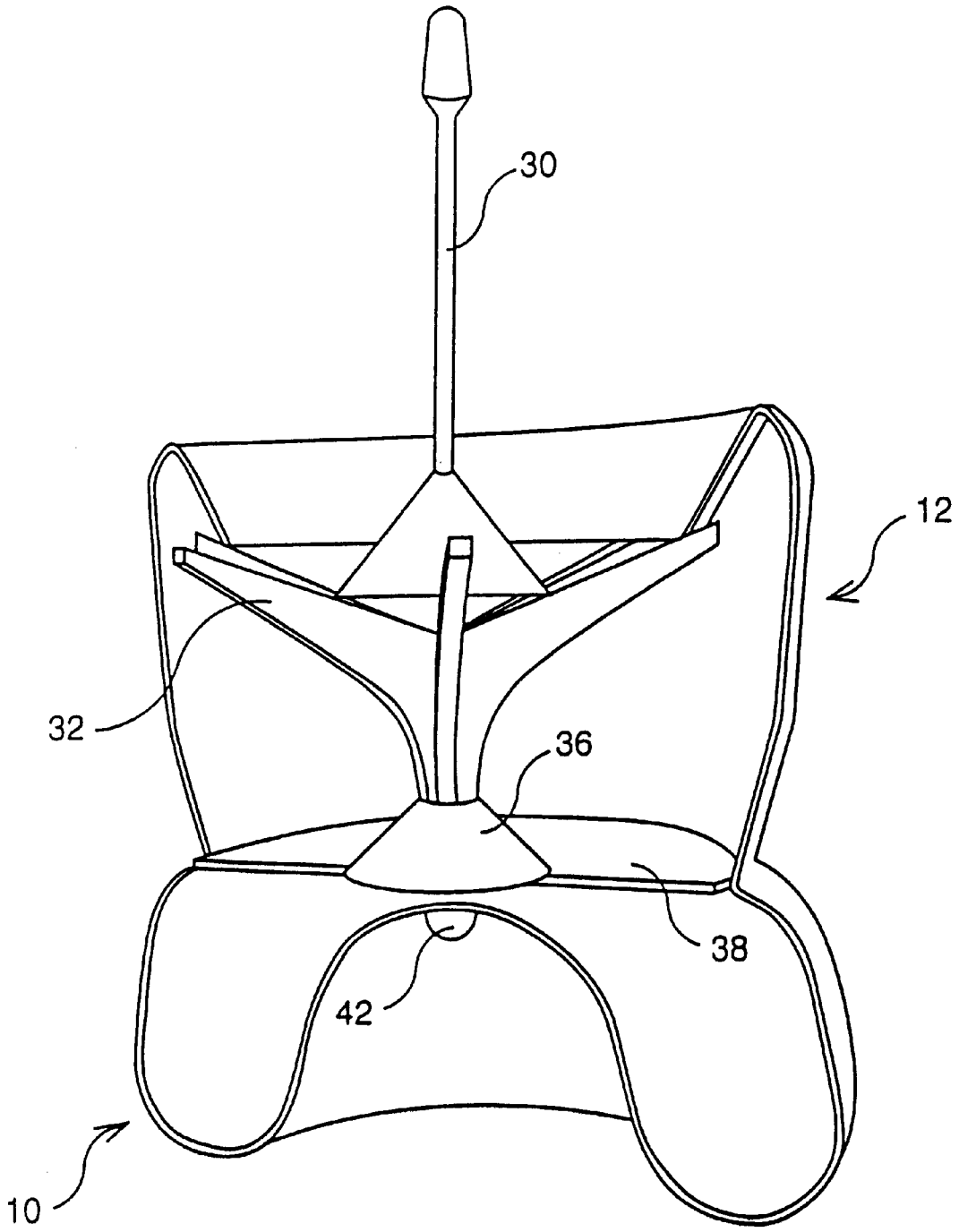
FIG. 3 represents a cross-sectional view of the collection device that shows the inner rotor and the compartments formed by its walls.

In the collection container 12 is located an inner rotor 28, free to rotate around its axis that is the mast 30. With reference to FIG. 3 that shows the collection container inside, it is seen that the inner rotor 28 comprises several radial partition walls 32 forming a plurality of compartments 33 around the axis or mast 30. In the preferred embodiment, the rotor comprises six partition radial walls thus forming six compartments. As shown on FIG. 3, a cone 34 interdependent with the rotor 28 is placed at the upper part of the latter with the aim of making easier the collection of refuse bags thrown in by the sailors from surrounding ships. At the base of the mast 30, there is also a supporting cone 36 that hides the pivot fixed at the plate that isolates the float 10 from the collection container 12, and on which the mast 30 and its rotor are mounted.

To collect refuse, collection bags are placed in each compartment formed by the rotor 28. The collection bag, the size of which suits the compartment size, is fixed by its two upper edges to the two partition walls 32 that define the compartment, by means of slides, hooks, or other appropriate mechanisms, so that any refuse bag thrown through the opening of the collection container fall into the collection bag located in any of the compartments.

At regular intervals, refuse collection bags are collected from a craft. This is done by means of a hatch door 40 that gives access to the inside of the collection container. The person in charge of collecting refuse bags unhooks the bag located in the first compartment on which the door gives access and removes it laterally from the collection container through the door 40. It is to be noted that unhooking is easy when bag's edges are fitted into slides, as the only thing to do is pulling the edges out of slides. Then, this person rotates the rotor by 600 so as to remove the second collection bag (manually or with a handling tool) from the second compartment, and so on . . . This operation is thus easy and does not require, as previously, to haul the garbage can and tip it over.

The sea garbage can just described may have any size while keeping proportions similar to those shown on FIGS. 1 to 3. As it can be seen on FIG. 3, the float has preferably the shape of a tore whose lower central part is hollow and comprises a central ring 42 for the hooking chain 16 (see FIG. 1). The diameter of the float is roughly similar to the overall height of the whole device. This way, if the diameter of the float is 2.20 m in the region of the fender, the total height of the garbage can is approximately 2.20 m, that is 0.90 m for the float's height and 1.30 m for the height of the collection container 12. In such a case, the diameter of the latter is approximately 1.80 m at its upper part. These dimensions gives the float a volume of 1400 l and the collection container a volume of 3000 l.

All parts of the sea garbage can, whether it is the float, the collection container, the rotor or the mast can be made of a plastic material (polyethylene, polypropylene, polycarbonate) or any material. However, it is better to make them with a composite material based on fibreglass. Made with such a material, the sea garbage can has an unladen weight of about 130 kg and a loaded weight of 330 kg.

Thanks to its original design, the sea garbage can or refuse collection container according to the invention has many advantages. Due to its float and shape thereof, it is very stable under a wind that can reach a speed of 150 km/h, or in 2-knot tide streams, that thereby make it insubmersible. Since the collection container is located above the float, and thus above the water level, limber holes 23 can be provided for to drain seawater (when waves' height is greater than device's height above the water level) or rainwater.

The fact remains, of course, that the main advantage of this sea garbage can is the possibility of collecting refuse placed in it by means of an easy operation, thanks to its lateral door. Although not strictly essential, handling is made still easier by the rotor that, on the one hand, enables to divide up the collected refuse volume and, on the other hand, gives easy access to the collection bags placed in a plurality of compartments. It is to be noted that more than one door might exist and that the rotor might have any number of separating walls (3, 4, 8 or 10), although six separating walls are better. At last, due to its shape and its size, that make this garbage look like a kind of large buoy, especially if its colour matches its environment, the garbage can according to the invention is perfectly suited to the sea or harbour environment.

What is claimed is:

1. A refuse collection device for moored ships, comprising a float adapted to buoy in water in a partially submerged position, with a waterline defining a submerged portion and a non-submerged portion of said float, a refuse collection container located above said waterline of said float, wherein said refuse collection container comprises (i) an opening on top to receive refuse, (ii) at least one compartment communicating with said opening, said compartment adapted to contain an open collection receptacle for receiving refuse; and (iii) at least one door in a wall of said refuse collection container to permit removal of said open collection receptacle from said refuse container.

2. The refuse collection device of claim 1, wherein said refuse collection container has a circular shape and further comprises an inner rotor with radial partition walls dividing said refuse collection container into a plurality of sub-compartments, each adapted to contain an open collection receptacle for receiving refuse thrown into said opening, wherein rotation of said rotor provides sequential access to each of said plurality of sub-compartments.

3. The refuse collection device of claim 2, wherein said inner rotor comprises six radial partition walls symmetrically distributed so as to form six sub-compartments, each adapted to contain an open collection receptacle for receiving refuse.

4. The refuse collection device of claim 1, further comprising a mast provided on top of said refuse collection container, said mast having means for signaling a location of the refuse collection device to ships.

5. The refuse collection device of claim 2, wherein said buoy has a circular shape and said refuse collection device further comprising a rubber fender adapted for damping shocks with ships, said fender being mounted on a portion of said buoy and said collection container at their greatest diameter.

6. The refuse collection device of claim 1, wherein said collection container has openings for draining rainwater or seawater.

7. The refuse collection device of claim 1, wherein said float has substantially the shape of a tore provided, at its lower surface center, with a ring for hooking an anchoring means.

* * * * *